US007264551B2

(12) United States Patent
Ghahraman

(10) Patent No.: US 7,264,551 B2
(45) Date of Patent: Sep. 4, 2007

(54) FOUR DIMENSIONAL BILLIARDS

(76) Inventor: Carlin Ghahraman, 301 Bonaire Ct., Danville, CA (US) 94506

( * ) Notice: Subject to any disclaimer, the term of this patent is extended or adjusted under 35 U.S.C. 154(b) by 0 days.

(21) Appl. No.: 10/505,714

(22) PCT Filed: Feb. 25, 2003

(86) PCT No.: PCT/US03/06015

§ 371 (c)(1),
(2), (4) Date: Aug. 24, 2004

(87) PCT Pub. No.: WO03/072211

PCT Pub. Date: Sep. 4, 2003

(65) Prior Publication Data

US 2005/0119061 A1 Jun. 2, 2005

Related U.S. Application Data

(60) Provisional application No. 60/359,416, filed on Feb. 25, 2002.

(51) Int. Cl.
*A63D 15/00* (2006.01)
*A63D 13/00* (2006.01)

(52) U.S. Cl. ..... 473/16; 473/14

(58) Field of Classification Search ..... 473/1, 473/4, 9, 10, 12, 14, 16, 496; 273/309, 108.33, 273/118 R, 126 R, 126 A; 108/59, 65, 103, 108/102

See application file for complete search history.

(56) References Cited

U.S. PATENT DOCUMENTS 895,786 A * 8/1908 Perkins ..... 473/16
1,049,668 A * 1/1913 Carlson and Wideen ..... 108/96
1,512,442 A * 10/1924 Arnold ..... 273/126 R
1,575,954 A * 3/1926 Walaschek ..... 108/65
1,706,329 A * 3/1929 Goldwin ..... 273/119 R
2,361,471 A * 10/1944 Fontaine, Jr. ..... 473/16
2,680,660 A * 6/1954 Stephens ..... 108/94
2,833,609 A * 5/1958 Lawless ..... 108/62
3,848,872 A * 11/1974 Velissaris ..... 273/125 R
3,947,035 A * 3/1976 Bouchard ..... 273/126 R
5,131,664 A * 7/1992 Medina ..... 473/16
6,761,260 B2 * 7/2004 Bettini et al. ..... 198/620

* cited by examiner

*Primary Examiner*—Mitra Aryanpour
(74) *Attorney, Agent, or Firm*—The Eclipse Group LLP

(57) ABSTRACT

A Playing surface (12) that introduces "movement" or "motion" as a fourth dimension to the traditional game of billiards by altering the natural inertia of the billiard balls is disclosed. In one embodiment of the playing surface (12), "motion" is introduced through turning or rotating of a portion (22) of the playing surface (12) of the billiards table (10) in the same plane as the playing surface. By affecting introducing a new element that would affect the inertia of the balls, players would then be required to not only make judgments about the distance, angle and force that the cue ball should strike the target ball, but must also consider how those factors may be effective by the introduction of an element that may alter the typical movement of the balls. Accordingly, players will be faced with moving targets, moving obstacles and the possible redirection and/or change in speed of the target balls as they attempt to hit the balls into the pockets of the table.

14 Claims, 3 Drawing Sheets

FOUR DIMENSIONAL BILLIARDS

RELATED APPLICATION

This application claims priority of U.S. provisional patent application Ser. No. 60/359,416, filed on Feb. 25, 2002, which is incorporated by reference into this application.

BACKGROUND OF THE INVENTION

1. Field of the Invention

This invention relates to a new sport similar to the traditional game of billiards. In particular, the invention provides additional elements and complexities to the traditional game of billiards.

2. Related Art

As a sport, today's billiards is viewed by the public as a very low-key game. Unlike other sports, billiards championship events do not draw much attention from the public. Any observer of a billiards championship competition will notice that the games have become much shorter in duration and easier to complete. A top champion usually finishes the game fairly quickly. The competitors' skills have advanced highly, while the standards of the game have remained static. Once a player starts the game, it is very likely that he or she will place the balls in the pockets with no effort—so much so that winning or losing has come down to just a few small errors by a participant in the last moments of a game. As a consequence, watching these games has become somewhat boring and monotonous, and because of this, public participation is extremely low as compared to other sports. To attract public interest and open new opportunities for participation in the game and championship competitions, the game of billiards must somehow become more exciting and challenging, with a view to eventual commercial gains.

A typical game of billiards consists of a standard set of fifteen (15) game balls that are identical to one another in size and mass, and a sixteenth ($16^{th}$) ball, the cue ball, usually of the same size and mass as the game balls. However, with automatic vending-machine type billiard tables the cue ball is slightly larger than the game balls to enable the return of the cue ball in the event that it inadvertently falls into one of the game table pockets.

The underlying object of traditional billiards is to knock the game balls into the pockets of the game table by way of an impact initiated by the cue ball. Variations of the game of billiards may include utilizing a number of game balls that is different than fifteen (15), changing the initial setup of the balls, adding any number of additional balls at various locations around the table or utilizing similar and dissimilar ball shapes and weights. Additionally, the markings on the balls may be altered from the standard numbering of 1 through 15, where the first eight balls are of various solid colors and the remaining seven are striped with various colors. For example, the markings on the balls may be altered to simulate other sports or sports paraphernalia. And finally, the ordering scheme in which the game balls are to be knocked into the game table pockets may be altered.

In analyzing traditional billiards, regardless of the variations described above, the game is technically based on three elements or dimensions: (1) distance, (2) angle, and (3) force. In other words, the three technically variants are the distance of the ball from the target, the angle of the ball in relationship to the target, and the force behind the ball provided by the player to drive the ball to the target. To the masters, handling these three elements has become too easy. Players at the championship levels have mastered the technique of handling these elements. To make the game more complicated, a new element or a new dimension must be added to the game. Once this is accomplished, the game will become more challenging to play and more interesting to watch.

SUMMARY OF THE INVENTION

A playing surface that introduces "motion" as a fourth dimension to the traditional game of billiards, by altering the natural inertia of the game balls during play is disclosed. A basic technique for altering the inertia of the balls is to place a portion of the playing surface in continuous motion Unlike traditional rectangular style billiards table with a solid surface, the playing surface may be a rectangular style billiards table having a portion of the surface designed to move in the same horizontal plane as the playing surface.

By way of example, one portion of the playing surface could act as a turntable that would rotate at variable speeds in both the clockwise and counter-clockwise direction, turning only that portion of the playing surface and delivering movement to the game. Thus, those billiards balls that are situated, or come to rest, on the moving section, will continue to move about that section of the table at the speed in which the underlying surface is moving. Players would then have to factor in the relative movement of those balls resting on the moving portion of the playing surface when attempting to hit target balls into the pockets of the table. Accordingly, players will be faced with moving targets and moving obstacles as they attempt to hit their target balls.

Alternatively, the moving portion of the playing surface could move at a velocity that would not allow the balls to stop on the moving surface, but would instead change the direction of the balls or alter the speed of the balls as they pass over the moving surface. In addition to having a portion of the playing table in motion, the movement of the balls may also be altered through electrostatic and electromagnetic forces applied to various portions of the playing surface. In this embodiment, the composition of the balls may need to be altered to respond to the electrostatic and electromagnetic forces applied to the playing surface. And finally, the balls themselves could be altered, through the use of a battery or other electrical source, to put or maintain the balls in motion.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

A more complete appreciation of the invention and many of the advantages thereof will be readily obtained as the same becomes better understood by references to the detailed description when considered in connection with the accompanying drawings. The components in the figures are not necessarily to scale, emphasis instead being placed upon illustrating the principles of the invention. In the figures, like reference numerals designate corresponding parts throughout the different views.

DETAILED DESCRIPTION

Figure 1:
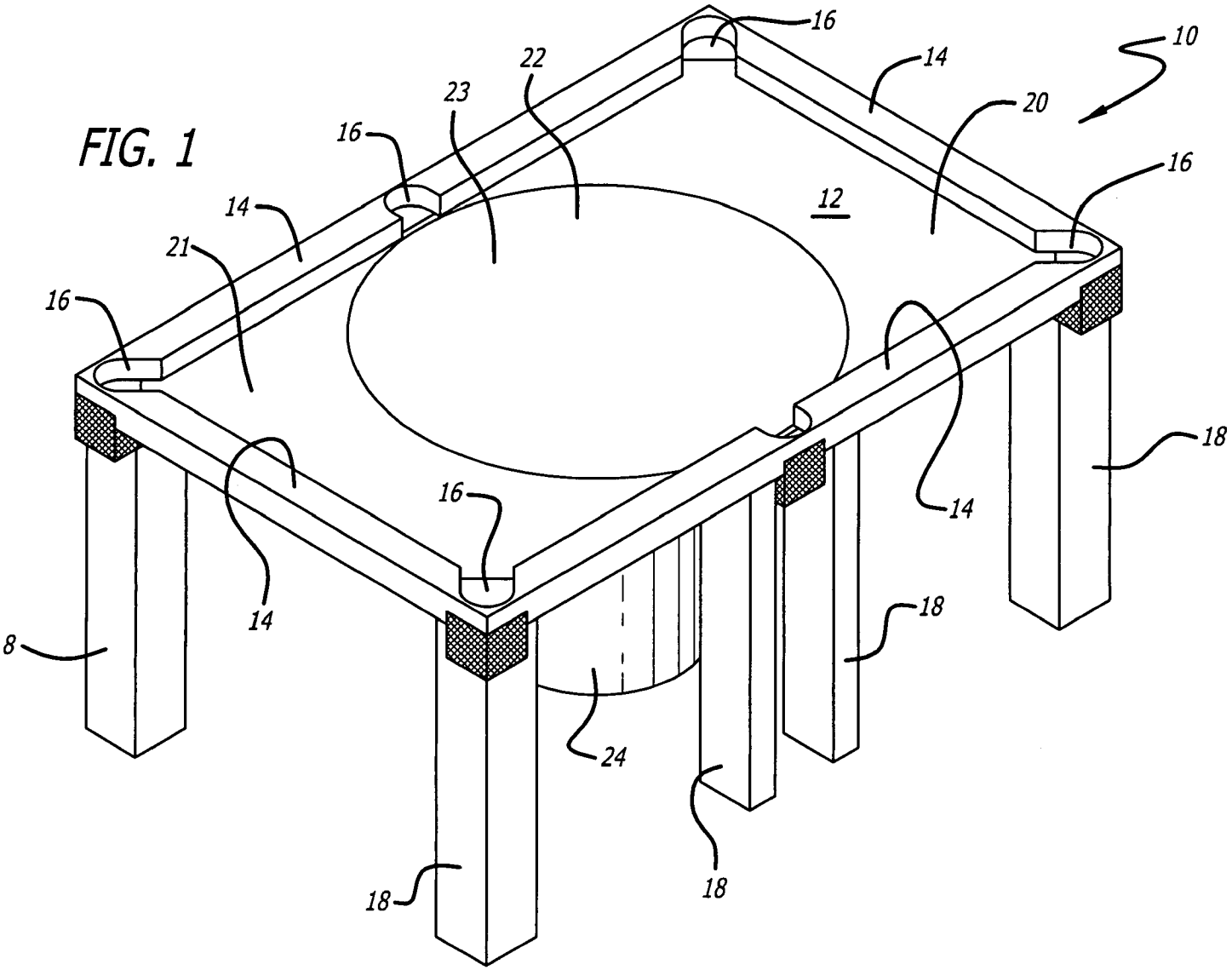
FIG. 1 is a perspective view of a billiards table of one embodiment of the invention.

Turning now to the detailed drawings, FIG. 1 illustrates a a table and/or billiards table 10 having a playing surface that provides for the addition of a new complexity to the traditional game of billiards by providing for a playing surface on the billiards table 10 that alters the inertia of the billiards balls while in motion or after the balls have come to rest on the playing surface. Although the playing surface is described in relation to a billiards table, other games utilizing moving objects on a stationary playing surface may be similarly modified to alter the inertia of the moving objects on the playing surface while the objects are at rest or in motion.

While the playing surface or table may be modified in many different ways to add the additional complexity of altering the direction, speed and other movements of the balls in the game of billiard, FIG. 1 illustrates an example embodiment of the playing surface. In this embodiment, the inertia of the moving balls may be altered by setting a portion of the playing surface in continuous or intermittent motion, at variable or constant speeds. One skilled in the art will, however, appreciate that the inertia of billiards balls, or other similar type of moving balls, may be altered in a number a different ways. In addition to mechanically altering the playing surface so that a portion of the surface may move, the composition of the balls may also be altered to respond to electromagnetic or electrostatic forces that may be applied at various locations on the playing surface of the table. Alternatively, the balls themselves may incorporate or include a power source, such as a battery, to self-propel the balls. The means for self propelling may including utilizing a electrostatic force, a electronmagnetic force and/or a mechanical force. Using these different techniques, the inertia of the moving balls may be altered by changing either or both the speed or direction of the balls in motion and/or at rest.

FIG. 1 illustrates an example embodiment of the playing surface on a billiards table 10. The billiards table 10 of FIG. 1 has the playing surface 12, padded edged frame members 14 surrounding the playing surface 12 from which the balls (not shown) may rebound, and pockets 16 to receive the balls during play. The playing surface 12, edged frame members 14 and pockets 16 are all supported by table legs 18.

The playing surface 12 includes at least two separate pieces: (1) the main or stationary surface 20 having a top face 21 (hereinafter the stationary top face 21); and (2) a supplemental or moving surface 22 also having a top face 23 hereinafter the moving top face 21). The stationary surface 20 and moving surface 22 may be designed and positioned relative to one another to form a standard playing surface 12 for a traditional game of billiards. While the standard playing surface 12 is typically rectangular in shape, the invention may also be incorporated into a table of varying shapes, such as circular, square or other similarly shaped tables.

As illustrated in FIG. 1, the stationary top face and the moving top face are generally found in the same horizontal plane with one another to create a smooth playing surface. However, one skilled in the art will recognize that the moving top surface may be positioned below or above the stationary top surface of the stationary surface. If positioned under the top surface, the movement of the balls may be altered through friction or other similar manner.

Figure 2:
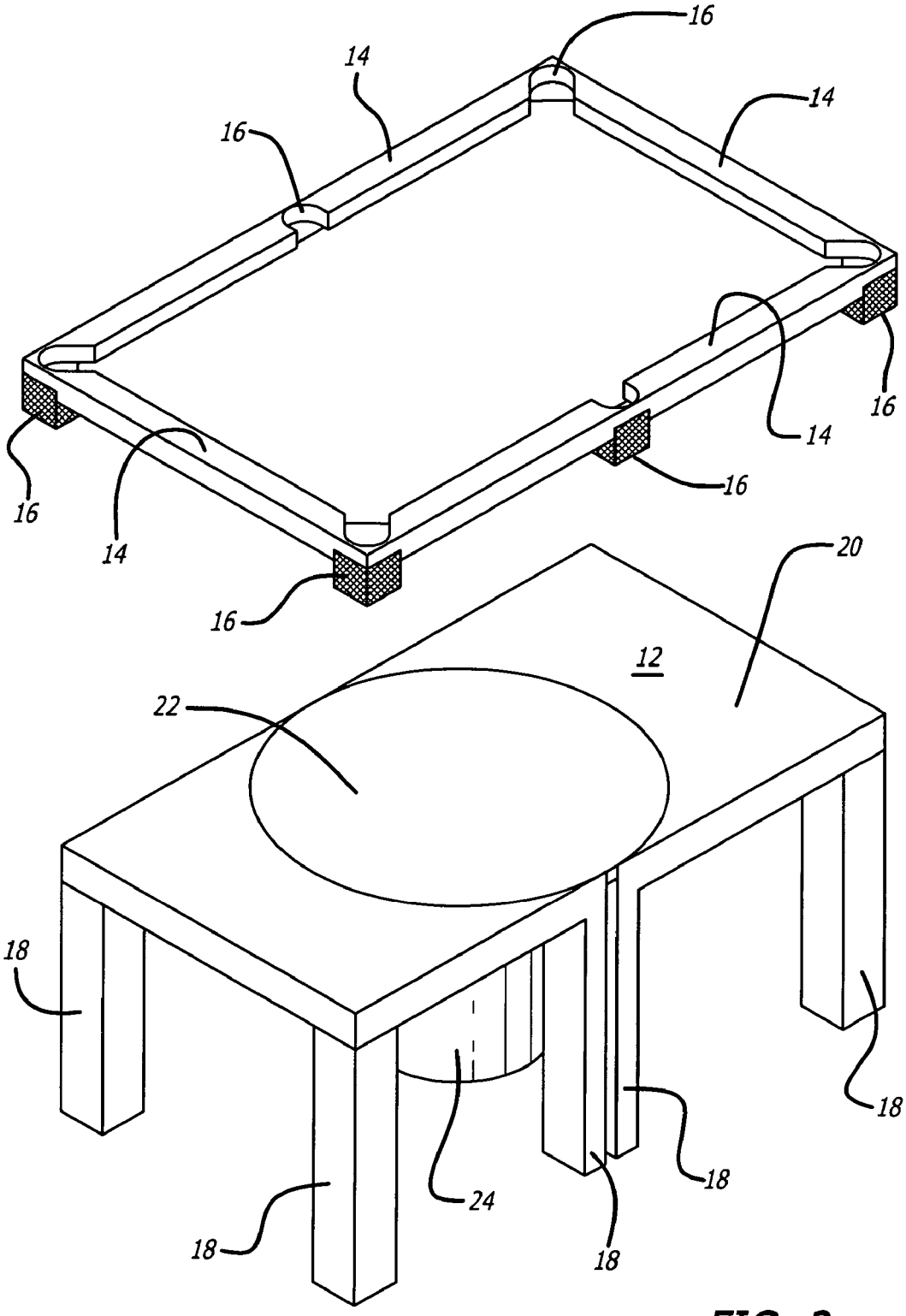
FIG. 2 is an exploded perspective view of billiards table of FIG. 1, illustrating the cushioned frame removed from the playing table.
Figure 3:
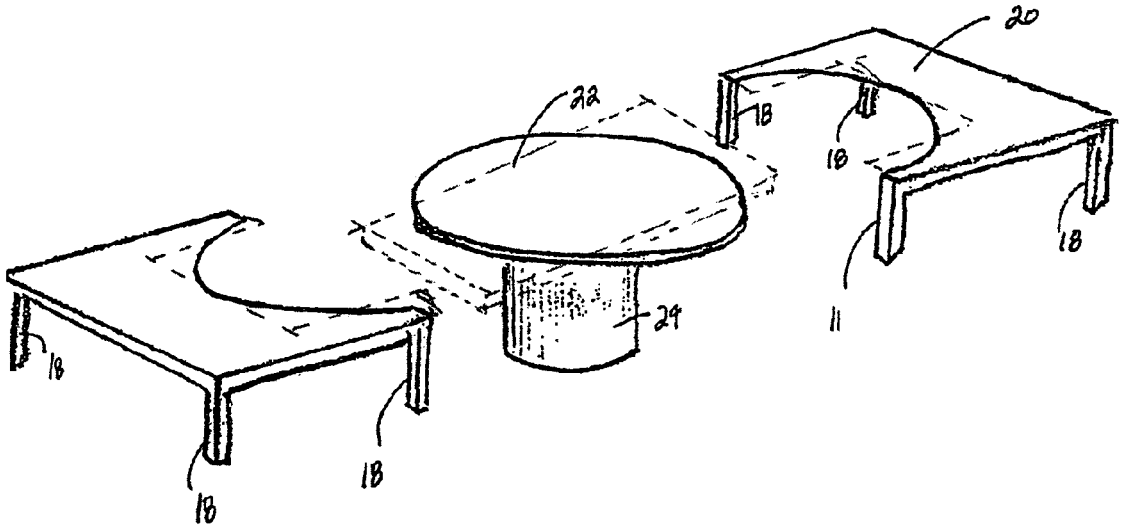
FIG. 3 is an exploded view of the playing table illustrated in FIG. 3.

As illustrated in FIGS. 1-3, in an example embodiment of the playing surface 12, the stationary surface 20 is depicted similar to a regular billiards table except that it has a round or circular opening located at one point along the surface 20. As illustrated in FIGS. 1-3, in this embodiment, the opening is located in the middle of the main surface 20. One skilled in the art will recognize that the position and number of the moving surfaces may vary in alternative embodiments. The moving surface 22 is then designed to have a surface area corresponding in size and shape to the opening in the stationary surface 20. The moving surface 22 may then be positioned within the opening on the stationary surface 20, such that the stationary top surface 21 of the stationary surface 20 and moving top surface 23 of the moving surface 22 are generally in the same horizontal plane, to form a smooth playing surface 12. Both the stationary and moving surfaces 20 and 22 may be supported by legs 18, which may also act as support legs 18 for the billiards table 10. The moving surface 22 may also be supported by support by alternative means, such as a pedestal 24 or other like support structure, or may be secured directly to the stationary surface 20 of the billiards table 10 by ordinary fastening mechanisms (not shown).

The stationary surface 20 does not move during play. The moving or supplemental surface 22, however, is designed to moving or rotate. When the moving surface 22 is circular, the surface 22 may be designed to rotate in the counter-clockwise or clockwise direction at predetermined or varying speeds in the plane of the playing surface 12. In addition to being circular in shape, the moving surface 22 may also be designed of other geometric shapes and sizes. For example, the moving surface 22 may be generally rectangular (as illustrated in phantom in FIG. 3) or square and may rotate in an elliptical manner, similar to a conveyor belt, moving the balls in a forward or backward direction.

Rotation of the supplemental or moving surface 22 may be accomplished by the use of gears or a gear train driven by an electric motor (not shown), of the type generally known in the art. The motor may be a single speed or variable speed motor and may be connected to the moving surface 22 in a manner that provides for the controlled movement of the moving surface 22 relative to the stationary surface 20. An electronic controller (not shown) or microprocessor may also be used to control the speed of the motor, which may give the players the capability of varying the speed and direction of the motor, while allowing for continuous, random or intermittent motion control.

The process performed by the electronic controller in controlling the speed of the motor may be performed by hardware or software. If the process is performed by software, the software may reside in software memory (not shown) in the electronic controller. The software in software memory may include an ordered listing of executable instructions for implementing logical functions (i.e., "logic" that may be implement either in digital form such as digital circuitry or source code or in analog form such as analog circuitry or an analog source such an analog electrical, sound or video signal), may selectively be embodied in any computer-readable (or signal-bearing) medium for use by or in connection with an instruction execution system, apparatus, or device, such as a computer-based system, processor-containing system, or other system that may selectively fetch the instructions from the instruction execution system, apparatus, or device and execute the instructions. In the context of this document, a "computer-readable medium" and/or "signal-bearing medium" is any means that may contain, store, communicate, propagate, or transport the program for use by or in connection with the instruction execution system, apparatus, or device. The computer readable medium may selectively be, for example but not limited to, an electronic, magnetic, optical, electromagnetic, infrared, or semiconductor system, apparatus, device, or propagation medium. More specific examples "a non-exhaustive list" of the computer-readable medium would include the following: an electrical connection "electronic" having one or more wires, a portable computer diskette (magnetic), a RAM (electronic), a read-only memory "ROM" (electronic), an erasable programmable read-only memory (EPROM or Flash memory) (electronic), an optical fiber (optical), and a portable compact disc read-only memory "CDROM" (optical). Note that the computer-readable medium may even be paper or another suitable medium upon which the program is printed, as the program can be electronically captured, via for instance optical scanning of the paper or other medium, then compiled, interpreted or otherwise processed in a suitable manner if necessary, and then stored in a computer memory.

When the supplement or moving surface 22 is operated at a low velocity, those billiards balls (not shown) that come to rest on the moving surface 22 of the table 10 will continue in motion with the movement of the moving surface 22 once the balls come to rest. Accordingly, this adds an additional dimension to the typical game of billiards by requiring players to factor in the relative movement of the target ball or the relative movement of other billiards balls in relation to the target ball when playing the game. While the invention is described as having at least one portion of the table in continuous motion, it is appreciated that the invention may also be designed to have at least one portion of the table capable of moving intermittently, at select times.

Alternatively, the moving surface 22 may be operated at a high velocity, which would prevent the balls from stopping on the moving surface 22. In this case, balls that come in contact with the moving surface 22 may be redirected, or the speed of the balls may be increased or altered as they move across the moving surface 22.

Generally, the normal playing surface 12 is a green woven cloth which can be adhered to or moulded on the top surface of the table. While the surface of other billiards tables may be made of several surfaces joined together, the green woven cloth is placed continuously over the top surface to give the appearance that the playing surface 12 is one piece.

Unlike traditional billiards tables 10, the woven cloth that is affixed or moulded to the playing surface 12 may be separately placed on the stationary and moving surfaces 20 and 22. By placing the cloth separately on the stationary surface 20 and the moving surface 22, a slight break in the playing surface 12 between the stationary and moving surfaces 20 and 22 of the billiards table 10 is created. The break, however, will be only of a distance that will allow the stationary surface 20 and moving surface 22 to rotate relative to one another without touching the other surface, or, if touching, the rubbing of the surfaces 20 and 22 against one another will not create enough friction to hinder the motion of the moving surface 22.

While the figures illustrate only one supplemental or moving surface 22, the playing surface 12 of the table 10 may include a number of rotating surfaces 22 located a different positions in the playing surface 12 and may be controlled through the use of one or more motors and/or controllers.

In operation, a user would turn on the motor either directly, through an on/off switch, or through a controller. Once on, the motor will set the moving parts of the table in motion. The game would then be played in a similar manner as the traditional billiards except that it requires greater technical expertise since the moving portion of the table may alter the speed and direction of the movement of the balls. Depending upon the speed of the motor, the movement of the moving surface may alter the speed and direction of the balls while either resting or in motion. This added complexity demands higher skills from the players. New skills will be required to master this game and new rules may even develop therefrom.

While various embodiments of the invention have been described, it will be apparent to those of ordinary skill in the art that many more embodiments and implementations are possible that are within the scope of this invention.

The invention claimed is:

1. A billiards game comprising:

A billiards table having a horizontal playing surface, the horizontal playing surface having two outer stationary surface portions and a rotatable surface portion positioned in between the two stationary surface portions; the billiard table further comprising an edged frame positioned at the perimeter of the horizontal playing surface, four corner pockets and two sidewall pockets; and means for causing movement of the rotatable surface;

wherein each of the two stationary surface portions include a stationary top face and the rotatable center surface includes a rotatable top face; wherein the stationary top face and the rotatable top face lie in the same plane; and wherein for a time period during which the game of billiards is played on the horizontal playing surface, the rotatable top face is in movement, whereby the movement of the rotatable top face adds complexity to the game of billiards and demands higher skills from the players.

2. The billiards game in claim 1, wherein rotation of the rotatable surface portion is circular.

3. The billiards game in claim 1, wherein rotation of the rotatable surface portion is elliptical.

4. The billiards game in claim 1, wherein the playing surface is generally rectangular in shape.

5. The billiards game in claim 1, wherein the playing surface is generally circular in shape.

6. The billiards game in claim 1, wherein the rotatable surface portion is generally rectangular in shape.

7. The billiards game in claim 1, wherein the rotatable surface portion is generally circular in shape.

8. The billiards game in claim 1, wherein the rotatable surface portion operates at a low velocity.

9. The billiards game in claim 1, wherein the rotatable surface portion operates at a high velocity.

10. The billiards game in claim 1, further comprising an electric motor for causing movement of the rotatable surface portion.

11. The billiard game of claim 1, further comprising means for affecting movement of billiard balls on the horizontal playing surface, wherein the affecting means is an electromagnetic force.

12. The billiard game of claim 1, further comprising means for affecting movement of billiard balls on the horizontal playing surface, wherein the affecting means is an electrostatic force.

13. The billiard game of claim 11, wherein the affecting means alters the inertia of a moving object on the horizontal playing surface.

14. The billiard game of claim 12, wherein the affecting means alters the inertia of a moving object on the horizontal playing surface.

* * * * *